US009038427B2

(12) United States Patent
Shen

(10) Patent No.: US 9,038,427 B2
(45) Date of Patent: May 26, 2015

(54) LOCK CYLINDER

(71) Applicant: Li-Szu Shen, Tainan (TW)

(72) Inventor: Li-Szu Shen, Tainan (TW)

( * ) Notice: Subject to any disclaimer, the term of this patent is extended or adjusted under 35 U.S.C. 154(b) by 154 days.

(21) Appl. No.: 13/855,851

(22) Filed: Apr. 3, 2013

(65) Prior Publication Data

US 2014/0298871 A1 Oct. 9, 2014

(51) Int. Cl.
*E05B 27/06* (2006.01)
*E05B 27/00* (2006.01)
*E05B 19/00* (2006.01)

(52) U.S. Cl.
CPC ..... *E05B 27/0075* (2013.01); *E05B 19/0035* (2013.01); *E05B 19/0047* (2013.01)

(58) Field of Classification Search
USPC ..... 70/358, 375, 419, 420, 421, 423, 427, 70/454, 490, 492, 493, 401, 407, 409
See application file for complete search history.

(56) References Cited

U.S. PATENT DOCUMENTS 1,892,419 A * 12/1932 Best ..... 70/375
3,500,670 A * 3/1970 Hawkins ..... 70/375
3,585,826 A * 6/1971 Mercurio et al. ..... 70/366
4,104,898 A * 8/1978 Fois ..... 70/419
5,475,997 A * 12/1995 Chung ..... 70/375
5,987,940 A * 11/1999 Chang ..... 70/38 A
6,058,752 A * 5/2000 Feder ..... 70/419
6,427,506 B1 * 8/2002 Prunbauer ..... 70/495
6,758,073 B2 * 7/2004 Yu ..... 70/358
7,240,526 B2 * 7/2007 Lee ..... 70/358
7,260,965 B2 * 8/2007 Hung ..... 70/339
2004/0172992 A1 * 9/2004 Huang ..... 70/358
2006/0096345 A1 * 5/2006 Chen ..... 70/493

* cited by examiner

*Primary Examiner* — Christopher Boswell
(74) *Attorney, Agent, or Firm* — Bacon & Thomas, PLLC

(57) ABSTRACT

A lock cylinder includes a housing and first and second key plugs rotatably received in the housing about an axis. The first and second key plugs are axially spaced in the housing and each includes a keyway for insertion of a corresponding key. The keyways of the first and second key plugs are aligned with each other along the axis. The lock cylinder further includes a blocking core fixedly mounted in the housing and between the first and second key plugs along the axis. The blocking core includes a through-hole aligned with the keyways of the first and second key plugs along the axis. The lock cylinder can effectively prevent an illegal picking tool from inserting into the keyways of the first and second key plugs and from turning the key plugs, thereby providing an enhanced anti-theft effect.

10 Claims, 11 Drawing Sheets

LOCK CYLINDER

BACKGROUND OF THE INVENTION

The present invention relates to a lockset and, more particularly, to a lock cylinder which promotes a burglarproof effect.

A type of conventional anti-theft lock cylinder for locks is generally includes an outer housing and an inner key plug rotatably received in the housing about an axis and having a keyway centrally extending along the axis. The housing and the key plug are internally provided with a plurality of tumbler pins for locking the key plug in the housing, thereby preventing unauthorized operation of the lock cylinder. When a special or corresponding key is inserted into the keyway of the key plug, the tumbler pins are lifted to a shear line between the housing and the key plug, allowing the key plug to be rotated relative to the housing to unlock the lock cylinder.

The lock cylinder mounted inside a lock is a sophisticated precise device with a critical function to prevent the lock from being easily and quickly unlocked by a burglar. One burglar or habitual thief, however, is still capable of easily unlocking the lock with a picking tool because the lock cylinder based on the prior art is equipped with a single key plug having a flat or cross keyway and, thus, is easily unlocked by the burglar who gradually inserts the picking tool into the keyway of the key plug. Specifically, those internal components of the lock cylinder are symmetrically arranged therein and will not be changed in their relative positions despite a turning action of the key plug relative to the housing in the process of inserting the picking tool into the keyway, failing to hinder the picking tool's constant probing to unlock the lock cylinder.

BRIEF SUMMARY OF THE INVENTION

Therefore, an objective of the present invention is to provide a lock cylinder to improve the aforementioned shortcoming and deficiency of the prior art. The lock cylinder of the present invention is adapted to be utilized with locks for effectively preventing any burglar from utilizing an illegal picking tool to unlock the lock cylinder, realizing better burglarproof effect of the locks.

To achieve this and other objectives, a lock cylinder of the present invention includes a housing adapted to be mounted to a lock and including front and rear ends spaced along an axis. The lock cylinder further includes at least two key plugs rotatably received in the housing about the axis and axially spaced in the housing. Each of the at least two key plugs includes a keyway extending along the axis. The keyways of the at least two key plugs allow insertion of a corresponding key for synchronously rotating the at least two key plugs. The keyways of the at least two key plugs are aligned with each other along the axis. The lock cylinder further includes a blocking core fixedly mounted in the housing and between the first and second key plugs along the axis. The blocking core includes a through-hole extending through the blocking core along the axis and aligned with the keyways of the at least two key plugs along the axis. Thereby, the lock cylinder of the present invention can effectively prevent an illegal picking tool from inserting into the keyways and from turning the key plugs to provide an enhanced anti-theft effect.

In a preferred form, the housing further includes a compartment extending from the front end through the rear end thereof along the axis. The at least two key plugs include a first key plug rotatably received in the compartment of the front end of the housing about the axis. The keyway of the first key plug has a first key passage with cruciform cross sections perpendicular to the axis. The at least two key plugs further include a second key plug rotatably received in the compartment of the rear end of the housing about the axis. The keyway of the second key plug has a second key passage with cruciform cross sections aligned with the cruciform cross sections of the first key passage of the first key plug. The through-hole has a third key passage with cruciform cross sections aligned with the cruciform cross sections of the first key passage of the first key plug. The key includes a blade having first and second code portions with cruciform cross sections. The key further includes a reduced portion formed on an intermediate section between the first and second code portions of the blade. The reduced portion is received in the through-hole of the blocking core to allow the first and second key plugs to be rotated together in the housing under rotation of the key when the first and second code portions of the key are respectively inserted into the first and second keyways of the first and second key plugs.

In another preferred form, the keyway of the first key plug has a first key passage with flat cross sections perpendicular to the axis. The keyway of the second key plug has a second key passage with flat cross sections aligned with the flat cross sections of the first key passage of the first key plug along the axis. The through-hole has a third key passage with flat cross sections aligned with the flat cross sections of the first key passage of the first key plug along the axis.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
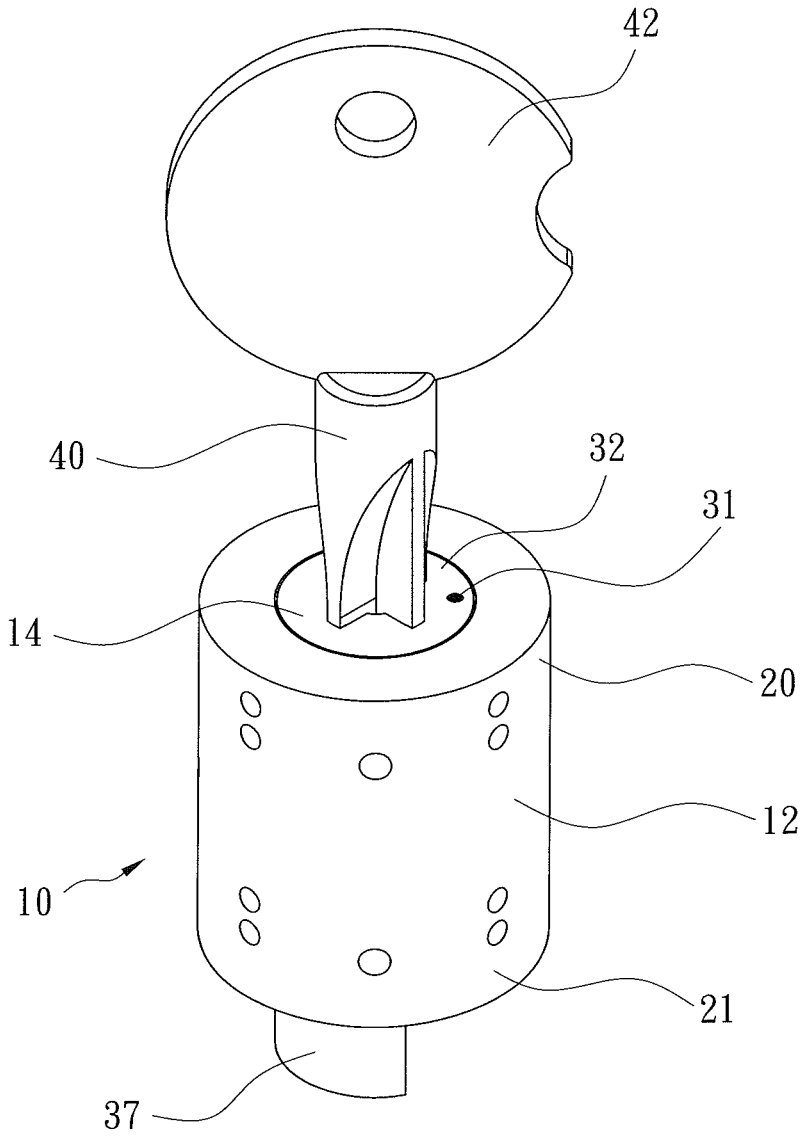
FIG. 1 shows a perspective view of a lock cylinder according to a first embodiment of the present invention with a key constructed in accordance with a first embodiment inserted into the lock cylinder.
Figure 2:
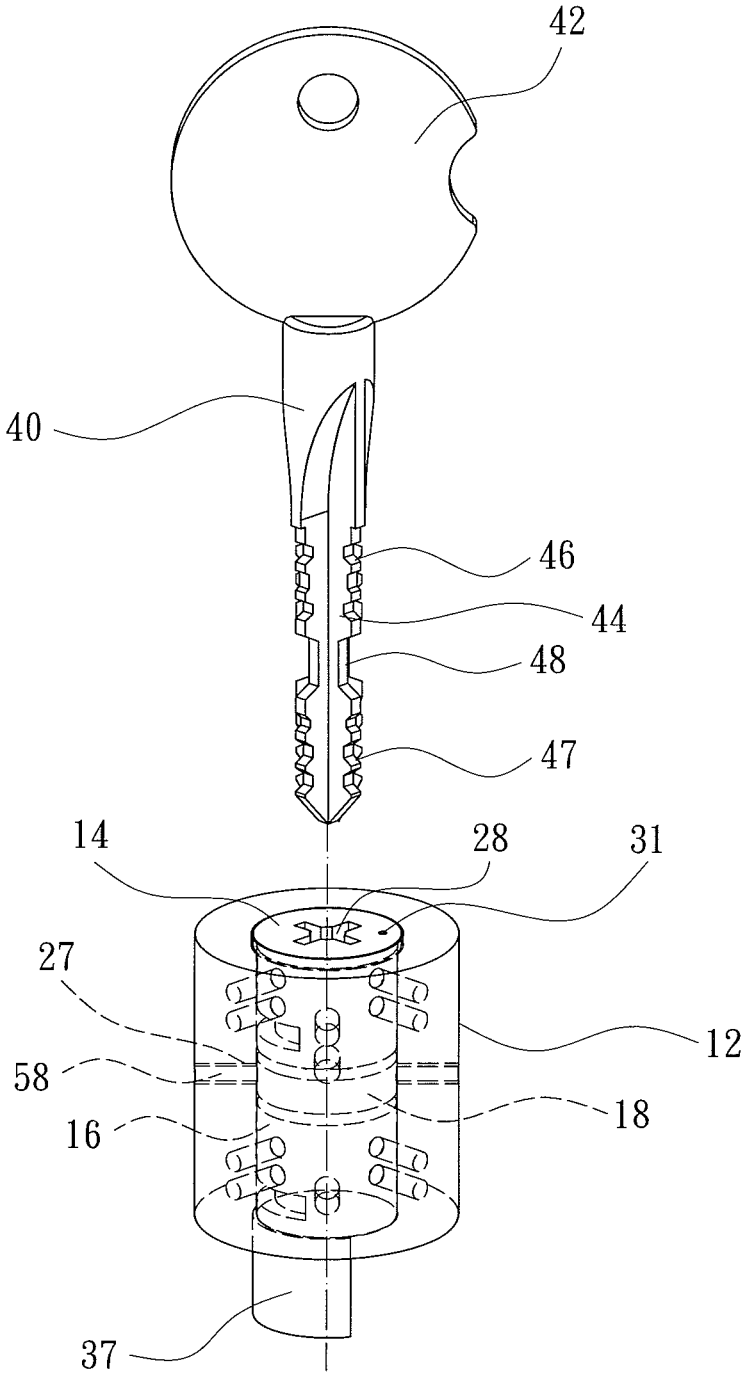
FIG. 2 shows a schematic view of the lock cylinder of FIG. 1 with the key separated from the lock cylinder.
Figure 3:
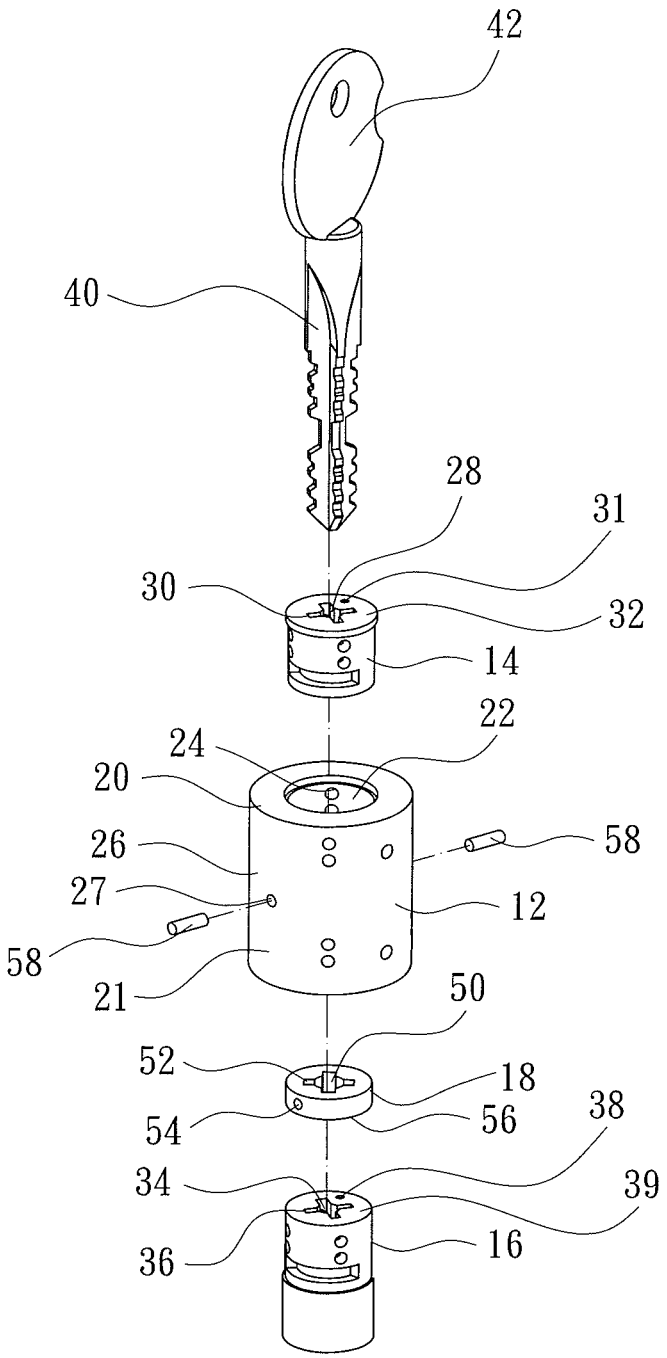
FIG. 3 shows an exploded, perspective view of the lock cylinder and the key of FIG. 1.
Figure 4:
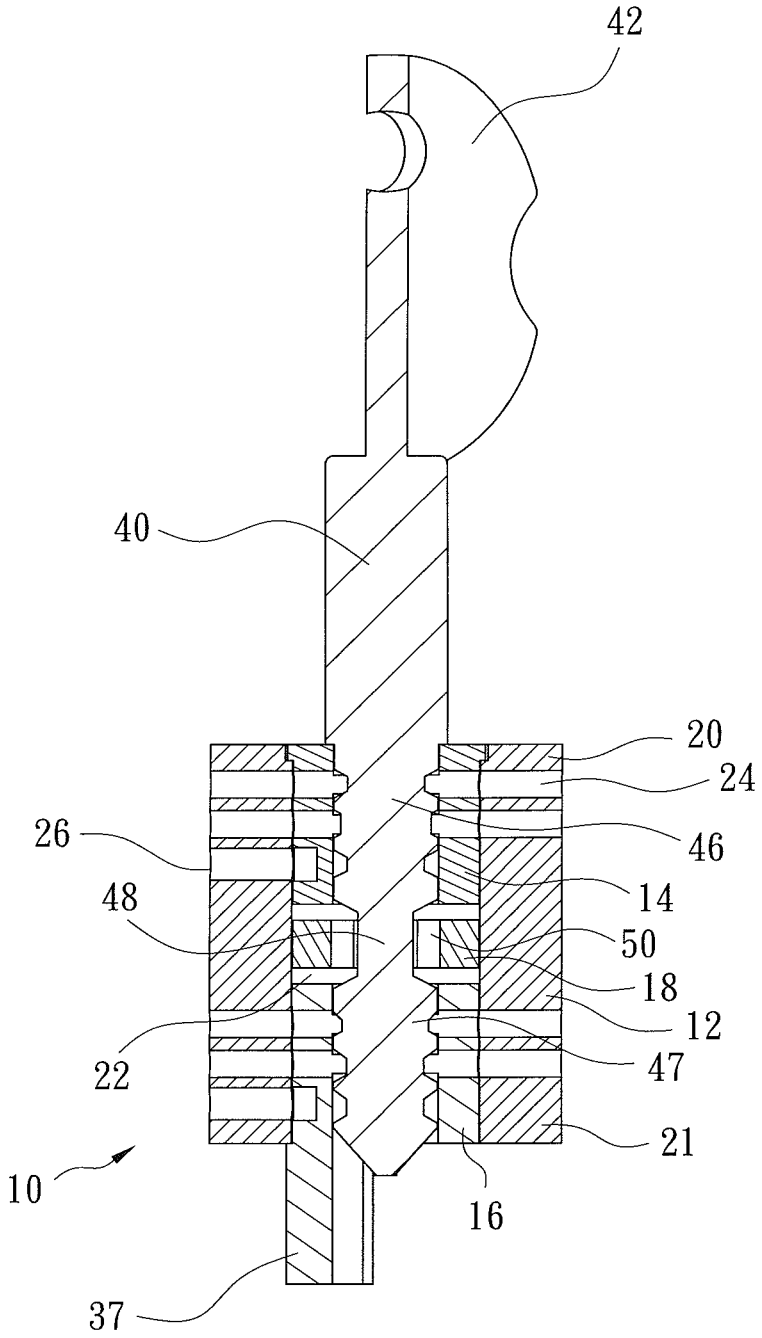
FIG. 4 shows a cross sectional view of the lock cylinder and the key of FIG. 1.
Figure 5:
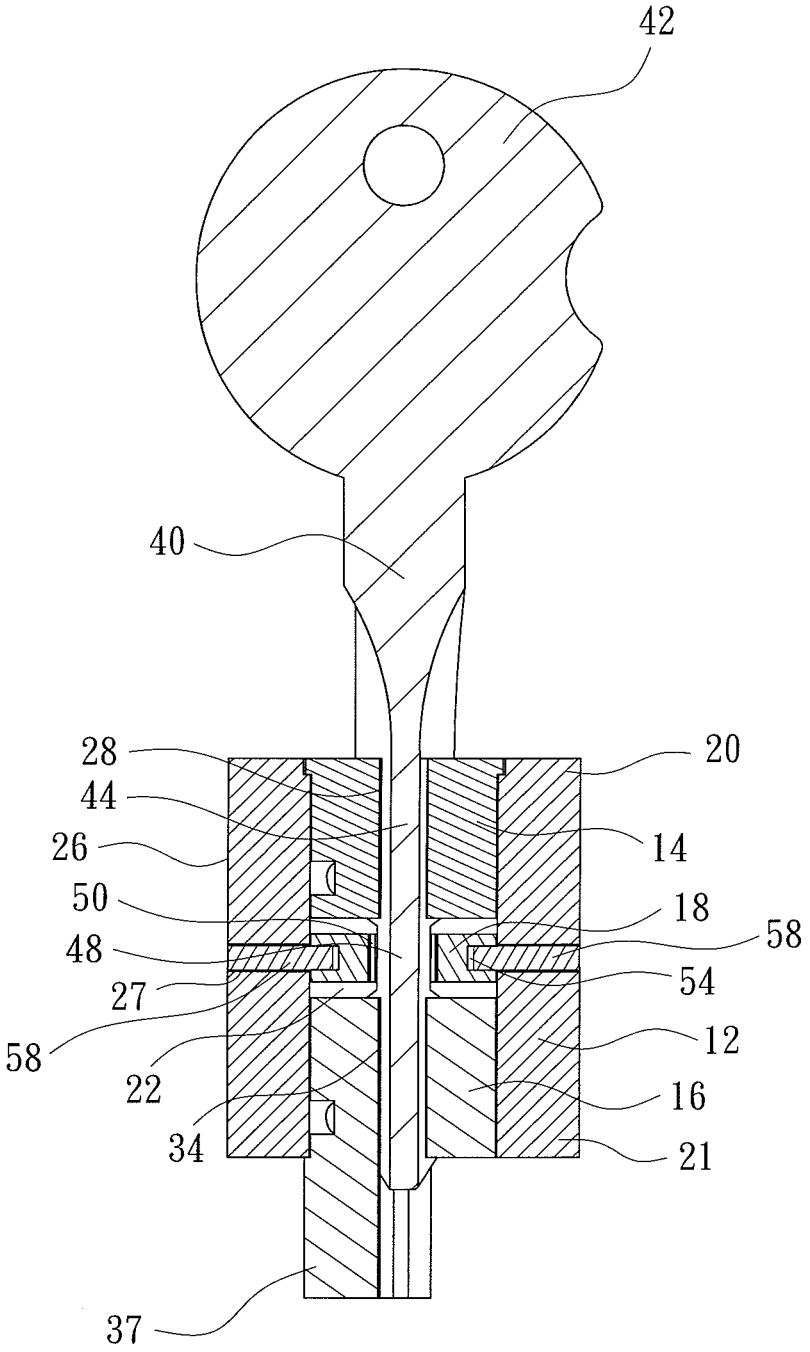
FIG. 5 shows another cross sectional view of the lock cylinder and the key of FIG. 1.
Figure 6:
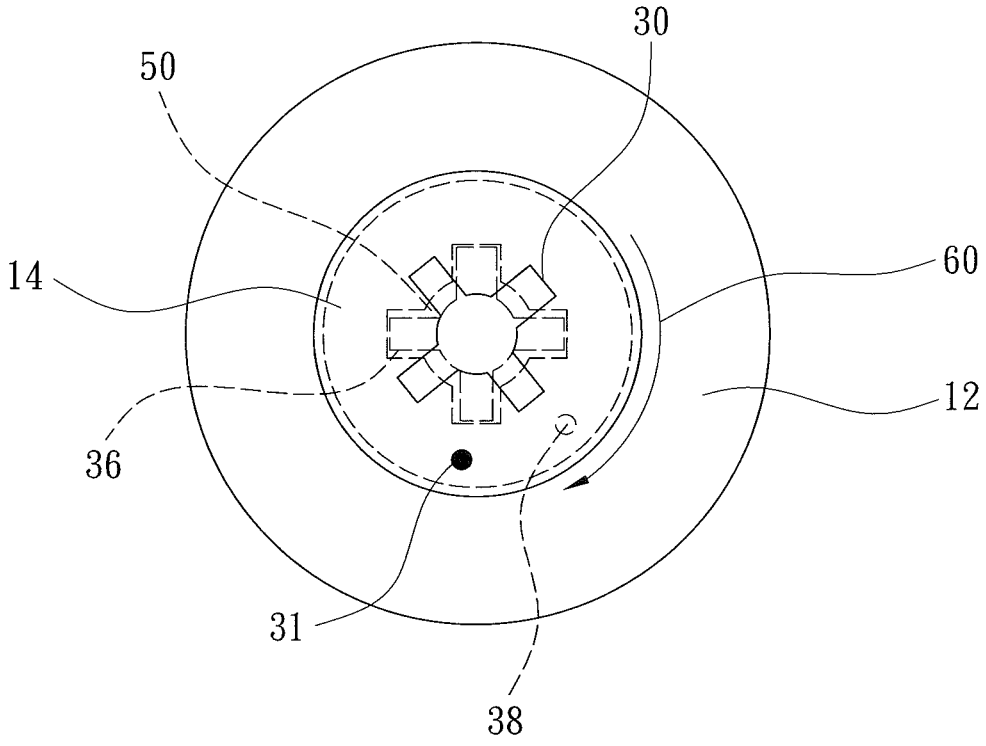
FIG. 6 shows a schematic top view of the lock cylinder of FIG. 2, illustrating a picking tool inserted into a first key plug of the lock cylinder.

A lock cylinder of a first embodiment of the present invention is shown in FIGS. 1-6 of the drawings and generally designated 10. The lock cylinder 10 includes a cylinder or housing 12, first and second key plugs 14 and 16, and a blocking core 18. The lock cylinder 10 may be utilized with locks of any desired type including, but not limited to, gate locks, cylinder locks, steering wheel locks, shackle locks, motorcycle locks, and bicycle locks.

The housing 12 of the lock cylinder 10 is adapted to be mounted to a lock body of a lock and includes front and rear ends 20 and 21 spaced along an axis and a compartment 22 extending from the front end 20 through the rear end 21 along the axis. The housing 12 further includes a plurality of pin holes 24 each extending from an outer circumference 26 of the housing 12 to the compartment 22. Furthermore, the housing 12 further includes two positioning holes 27 each extending from the outer circumference 26 of the housing 12 to the compartment 22.

The first key plug 14 is rotatably received in the compartment 22 of the front end 20 of the housing 12 about the axis. The first key plug 14 includes a first keyway 28 extending therethrough along the axis and having a first key passage 30 with cruciform cross sections perpendicular to the axis. A first insertion reference point 31 for keys is provided on a front end face 32 of the first key plug 14.

The second key plug 16 is rotatably received in the compartment 22 of the rear end 21 of the housing 12 about the axis and spaced from the first key plug 14 along the axis. The second key plug 16 includes a second keyway 34 extending along the axis and having a second key passage 36 with cruciform cross sections corresponding to that of the first key passage 30. The second key passage 36 is aligned with the first key passage 30 of the first key plug 14 along the axis. Namely, the cross sectional contour of the second key passage 36 is aligned with that of the first key passage 30 along the axis. An actuating portion 37 is formed on an outer end of the second key plug 16 for unlocking a bolt or similar member of the lock in which the lock cylinder 10 is mounted upon rotation of the second key plug 16. A second insertion reference point 38 for keys is provided on a front end face 39 of the second key plug 16 and aligned with the first insertion reference point 31 in an axial direction parallel to the axis.

It should be appreciated that the housing 12 and the first and second key plugs 14 and 16 are internally provided with a plurality of tumbler pins (not shown) and a plurality of springs (not shown) for biasing an end of each tumbler pin into one of the first and second keyways 28 and 34, thereby locking the first and second key plugs 14 and 16 in the front and rear ends 20 and 21 of the housing 12 respectively. Furthermore, the first and second key passages 30 and 36 allow insertion of a special or corresponding key 40 for synchronously rotating the first and second key plugs 14 and 16. In this embodiment, the key 40 includes a bow 42 for a user's grip and an elongated blade 44 having first and second code portions 46 and 47 spaced along a length thereof. Each of the first and second code portions 46 and 47 has cruciform cross sections. A reduced portion 48 is formed on an intermediate section between the first and second code portions 46 and 47 of the key 40. When the key 40 is inserted into the first and second keyways 28 and 34 of the first and second key plugs 14 and 16, the tumbler pins in the first and second key plugs 14 and 16 are respectively lifted by serrations or concavities of the first and second code portions 46 and 47, allowing the first and second key plugs 14 and 16 to be rotated together in the housing 12 under rotation of the key 40.

The blocking core 18 is fixedly mounted in the compartment 22 of the housing 12 and between the first and second key plugs 14 and 16 along the axis. The blocking core 18 is in the form of a ring and includes a through-hole 50 extending therethrough along the axis. In this embodiment, the through-hole 50 has a third key passage 52 with cruciform cross sections aligned with the first key passage 30 of the first key plug 14 along the axis. The blocking core 18 further includes two fixing holes 54 each extending from an outer circumference 56 thereof toward but spaced from the through-hole 50. The blocking core 18 is engaged with the housing 12 by extending pins 58 through the positioning holes 27 of the housing 12 into the fixing holes 54 of the blocking core 18 respectively. The through-hole 50 with the third key passage 52 allows the second code portion 47 of the key 40 to be extended through. In operation, when the key 40 is inserted into the first and second keyways 28 and 34 of the first and second key plugs 14 and 16, the reduced portion 48 of the key 40 is received in the through-hole 50 of the blocking core 18, allowing smooth rotation of the key 40 in the housing 12.

With the second key passage 36 of the second key plug 16 aligned with the first key passage 30 of the first key plug 14, the lock cylinder 10 of the present invention can effectively avoid any burglar's illegal picking tool to be inserted into the second keyway 34 of the second key plug 16 for unlocking the lock cylinder 10. Specifically, the first key plug 14 will result in slight rotation relative to the second key plug 16 when a burglar's picking tool (not shown) is inserted into the first key passage 30 of the first key plug 14 (see the arrow 60 in FIG. 6), so that the first key passage 30 of the first key plug 14 is rotated to a position non-aligned with the second key passage 36 of the second key plug 16 with a malposition created between the first and second insertion reference points 31 and 38. As such, the picking tool which has successfully passed through the first key passage 30 of the first key plug 14 cannot be inserted into the second key passage 36 of the second key plug 16 due to compressive deformation of the picking tool and/or misalignment of the first and second key passages 30 and 36.

Furthermore, with the provision of the blocking core 18 of the present invention, illegal picking tools can be further prevented from unlocking the lock cylinder 10. Specifically, even if one picking tool has passed through the first key passage 30 of the first key plug 14 and the through-hole 50 of the blocking core 18 and then into the second key passage 36 of the second key plug 16, the first and second key plugs 14 and 16 will be unable to be rotated in the housing 12 by the picking tool, for the picking tool will cause elastic expansion and be stuck in the through-hole 50 of the blocking core 18 which is fixed in the housing 12 and can not be rotated by the picking tool. Thus, the lock cylinder 10 of the present invention can effectively prevent illegal picking tools from inserting into and/or from turning the first and second key plugs 14 and 16 to provide an enhanced anti-theft effect.

Figure 7:
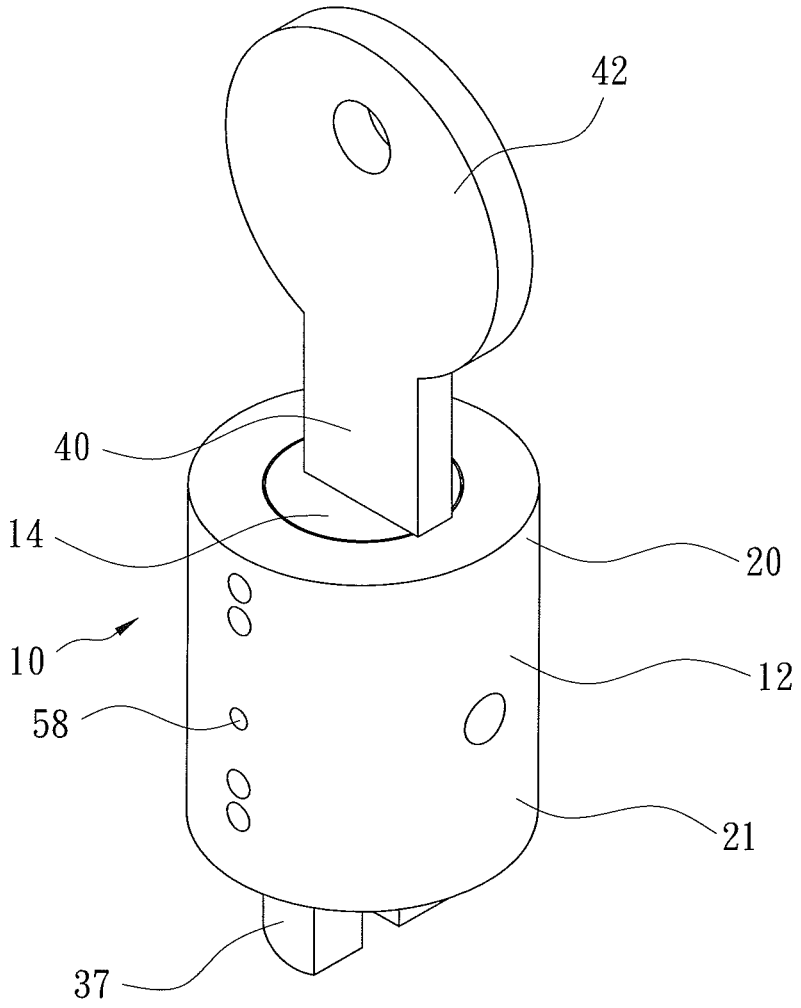
FIG. 7 shows a perspective view of a lock cylinder according to a second embodiment of the present invention with a key constructed in accordance with a second embodiment inserted into the lock cylinder.
Figure 8:
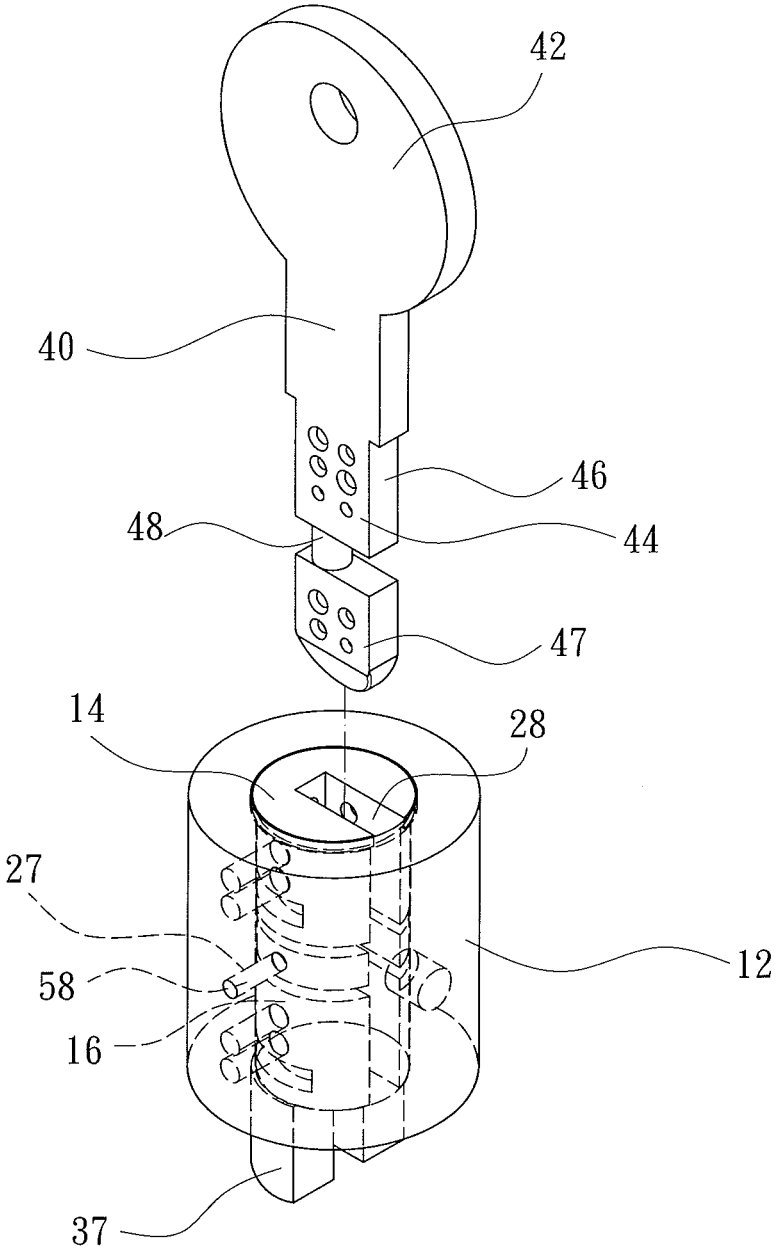
FIG. 8 shows a schematic view of the lock cylinder of FIG. 7 with the key separated from the lock cylinder.
Figure 9:
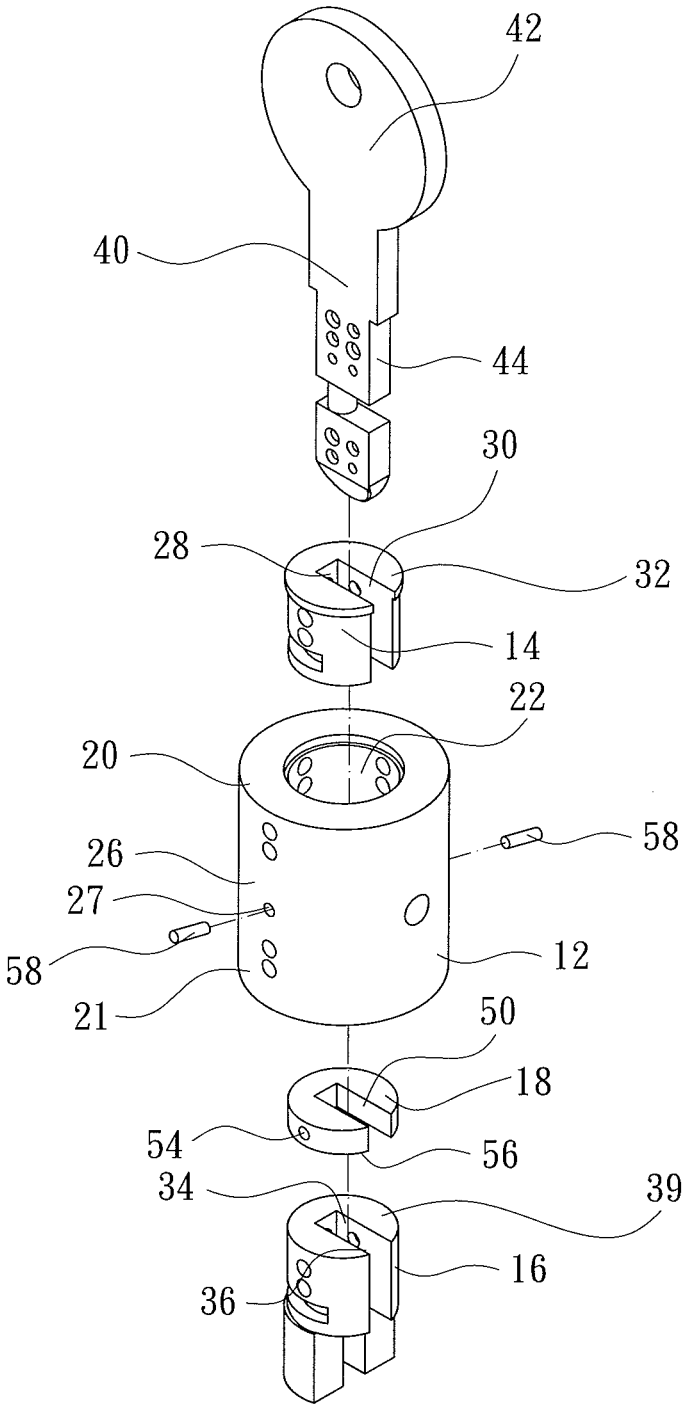
FIG. 9 shows an exploded, perspective view of the lock cylinder and the key of FIG. 7.
Figure 10:
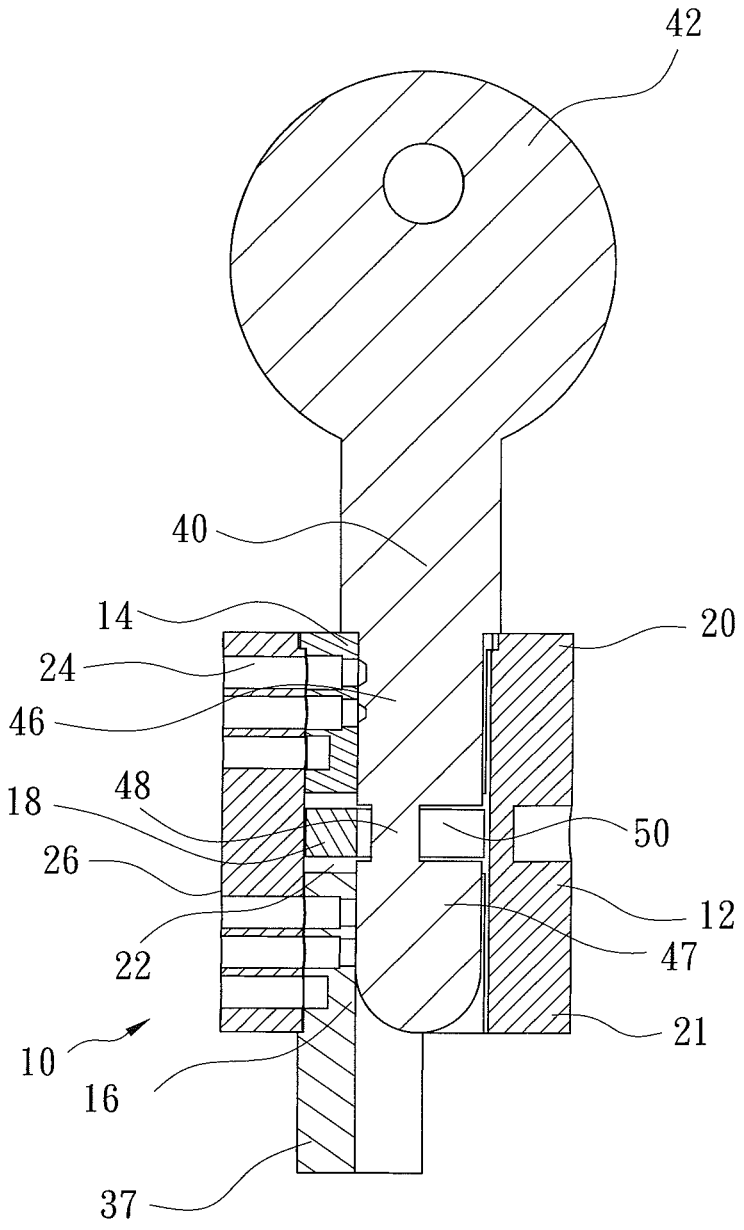
FIG. 10 shows a cross sectional view of the lock cylinder and the key of FIG. 7.
Figure 11:
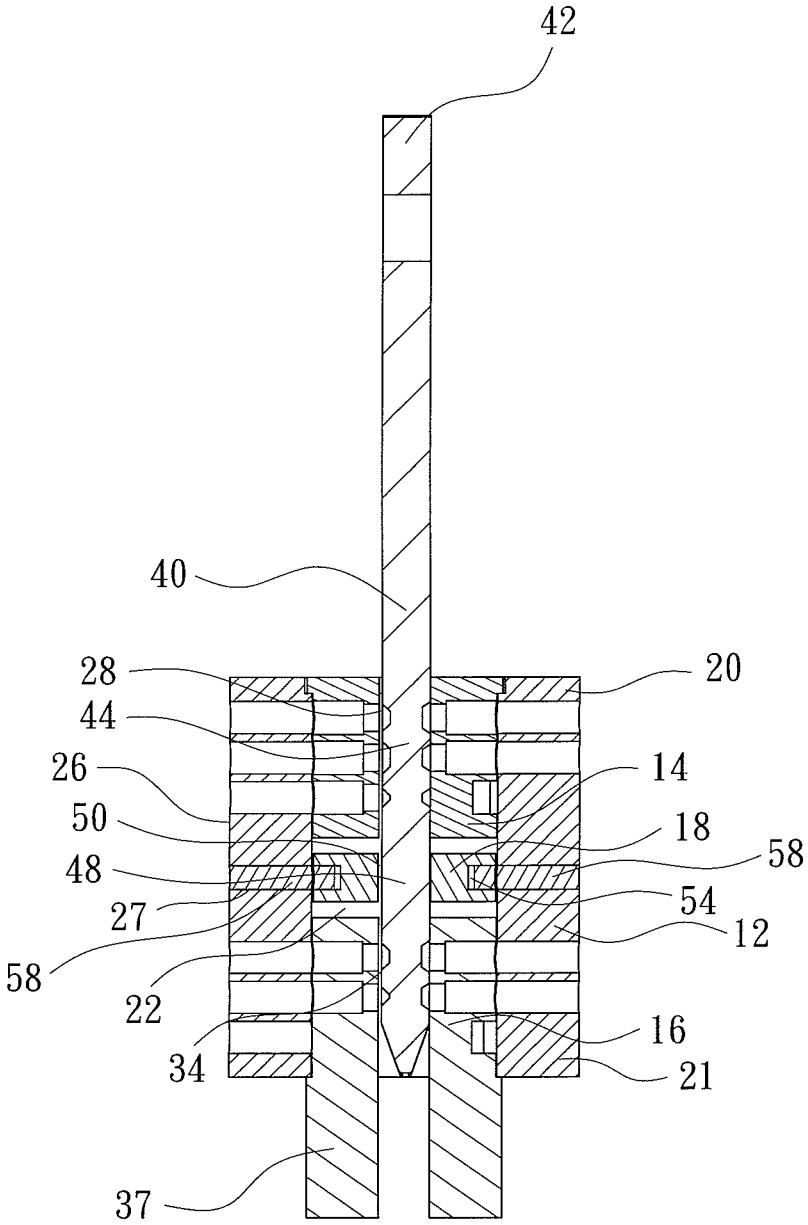
FIG. 11 shows another cross sectional view of the lock cylinder and the key of FIG. 7.

FIGS. 7-11 of the drawings show a second embodiment of the lock cylinder 10 according to the present invention. Description of the parts of the lock cylinder 10 shown in FIGS. 7-11 identical to those shown in FIGS. 1-6 is omitted. In particular, each of the first and second key passages 30 and 36 has flat cross sections perpendicular to the axis, and the first and second code portions 46 and 47 of the blade 44 of the key 40 respectively have flat cross sections corresponding to those of the first and second key passages 30 and 36 of the first and second key plugs 14 and 16. Further, the through-hole 50 of the blocking core 18 also has flat cross sections corresponding to that of the second key passage 36 to allow second code portions 47 of the key 40 to be extended through.

It is to be understood that the lock cylinder 10 of the present invention is not limited to the specific embodiments described and/or shown herein, and that the lock cylinder 10 according to the present invention can includes more than two key plugs having keyways aligned with one another. The contours of the first and second key passages 30 and 36 can be other geometric shapes in cross section.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims.

The invention claimed is:

1. A lock cylinder comprising:

a housing adapted to be mounted to a lock and including front and rear ends spaced along an axis;

at least two key plugs rotatably received in the housing about the axis and axially spaced in the housing, with each of the at least two key plugs including a keyway extending along the axis, with the keyways of the at least two key plugs allowing insertion of a corresponding key for synchronously rotating the at least two key plugs, with the keyways of the at least two key plugs aligned with each other along the axis; and a blocking core fixedly mounted in the housing and between the at least two key plugs along the axis, with the blocking core including a through-hole extending through the blocking core along the axis and aligned with the keyways of the at least two key plugs along the axis;

wherein the blocking core is arranged to remain fixedly mounted in the housing when the at least two key plugs are synchronously rotated about the axis by the corresponding key, such that the blocking core does not correspondingly rotate about the axis under rotation of the key.

2. The lock cylinder as claimed in claim 1, with the housing further including a compartment extending from the front end through the rear end thereof along the axis, with the at least two key plugs including a first key plug rotatably received in the compartment of the front end of the housing about the axis, with the keyway of the first key plug having a first key passage with cruciform cross sections perpendicular to the axis, with the at least two key plugs further including a second key plug rotatably received in the compartment of the rear end of the housing about the axis, with the keyway of the second key plug having a second key passage with cruciform cross sections aligned with the cruciform cross sections of the first key passage of the first key plug, with the through-hole having a third key passage with cruciform cross sections aligned with the cruciform cross sections of the first key passage of the first key plug.

3. The lock cylinder as claimed in claim 2, with the key including a blade having first and second code portions with cruciform cross sections, with the key further including a reduced portion formed on an intermediate section between the first and second code portions of the blade, with the reduced portion received in the through-hole of the blocking core to allow the first and second key plugs to be rotated together in the housing under rotation of the key when the first and second code portions of the key are respectively inserted into the first and second keyways of the first and second key plugs.

4. The lock cylinder as claimed in claim 1, with the housing further including a compartment extending from the front end through the rear end thereof along the axis, with the at least two key plugs including a first key plug rotatably received in the compartment of the front end of the housing about the axis, with the keyway of the first key plug having a first key passage with flat cross sections perpendicular to the axis, with the at least two key plugs further including a second key plug rotatably received in the compartment of the rear end of the housing about the axis, with the keyway of the second key plug having a second key passage with flat cross sections aligned with the flat cross sections of the first key passage of the first key plug along the axis, with the through-hole having a third key passage with flat cross sections aligned with the flat cross sections of the first key passage of the first key plug along the axis.

5. The lock cylinder as claimed in claim 4, with the key including a blade having first and second code portions with flat cross sections, with the key further including a reduced portion formed on an intermediate section between the first and second code portions of the blade, with the reduced portion received in the through-hole of the blocking core to allow the first and second key plugs to be rotated together in the housing under rotation of the key when the first and second code portions of the key are respectively inserted into the first and second keyways of the first and second key plugs.

6. The lock cylinder as claimed in claim 1, wherein the blocking core further comprises at least one fixing hole extending from an outer circumference of the blocking core toward the through hole.

7. The lock cylinder as claimed in claim 6, wherein the housing further comprises a compartment extending from the front end through the rear end thereof along the axis, and at least one positioning hole extending from an outer circumference of the housing to the compartment.

8. The lock cylinder as claimed in claim 7, wherein the blocking core is configured to engage the housing by extending pins through the positioning holes of the housing into the fixing holes of the blocking core.

9. The lock cylinder as claimed in claim 1, wherein the at least two key plugs include a first key plug and a second key plug, the first key plug having a front end face provided with a first insertion reference point, and the second key plug having a front end face provided with a second insertion reference point, wherein the first and second insertion reference points are aligned in an axial direction parallel to the axis.

10. The lock cylinder as claimed in claim 1, wherein the at least two key plugs include a first key plug and a second key plug, and wherein an actuating portion is formed on an outer end of the second key plug for unlocking a bolt.

* * * * *